United States Patent [19]

Reed, Jr. et al.

[11] 4,263,069

[45] Apr. 21, 1981

[54] INHIBITOR FOR GUN PROPELLANTS

[75] Inventors: Russell Reed, Jr., Ridgecrest, Calif.; Kenneth L. Moore, Silver Spring, Md.

[73] Assignee: The United States of America as represented by the Secretary of the Navy, Washington, D.C.

[21] Appl. No.: 91,286

[22] Filed: Nov. 5, 1979

[51] Int. Cl.[3] ..... C06B 45/22

[52] U.S. Cl. ..... 149/11; 149/9; 149/10

[58] Field of Search ..... 149/9, 11, 10, 19.2

[56] References Cited

U.S. PATENT DOCUMENTS

| | | | |
|---|---|---|---|
| Re. 27,025 | 1/1971 | McDonald | 149/11 |
| 3,137,741 | 6/1964 | Vondersmith et al. | 149/10 |
| 3,665,862 | 5/1972 | Lane | 102/103 |
| 3,767,488 | 10/1973 | Seals | 149/11 |
| 3,948,697 | 4/1976 | Flanagan et al. | 149/11 |
| 3,984,264 | 10/1976 | Lampert | 149/11 |
| 3,985,592 | 10/1976 | Hackett et al. | 149/11 |

*Primary Examiner*—Edward A. Miller

*Attorney, Agent, or Firm*—R. S. Sciascia; W. Thom Skeer; Lloyd E. K. Pohl

[57] ABSTRACT

Gun propellant is coated with an oligomer having the structure:

$$\overset{H}{RN}\,(CH_2CH_2\overset{H}{N})_n\,(CH_2CH_2\overset{R}{N})_m\,CH_2CH_2NHR$$

wherein R is $-CH_2CH_2CH_2Si(OCH_3)_3$; wherein n is an integer of from 5 to 50 and wherein m is an integer of from 1 to 5. The purpose of the coating is to decrease the peak pressure produced but make the pressure that is produced last longer.

4 Claims, No Drawings

INHIBITOR FOR GUN PROPELLANTS

BACKGROUND OF THE INVENTION

1. Field of the Invention

This invention relates to gun propellants. More particularly, this invention relates to a method for improving the efficiency of and lowering the peak pressure produced by high force, high flame temperature gun propellants.

2. Description of the Prior Art

The military services utilize two types of gun propellants. One type is made up of extruded cylinders having one or more perforations. The other is called ball powder and is made up of spherical shaped particles, the outer portions of which contain an inert plasticizer such as dibutyl phthalate. The dibutyl phthalate is for the purpose of deterring the initial phase of burning.

Commonly, the extruded propellant is either a double base propellant made up of nitrocellulose and a second ingredient such as nitroglycerine, trimethylol trinitrate or the like or a single base propellant made up of nitrocellulose alone. These propellants produce a mass impetus of 340,000 or greater and a high flame temperature on the order of 3000° K. or more when they are burned. When these propellants are burned, pressure in the gun chamber builds up quickly to a high peak and then rapidly decays. This requires the use of a heavy (thick) chamber in order to insure against rupture due to the high peak pressure. These propellants are consumed before the projectile has travelled more than a fraction of the length of the barrel. This process has an inherently low efficiency so that large amounts of propellant are required, an effect which tends to cause erosion of the throat area of the chamber.

SUMMARY OF THE INVENTION

It has now been found that bore erosion produced by the aforementioned double base and single base gun propellants can be significantly reduced by coating the propellannt grains with an oligomer having the formula:

$$\overset{H}{RN}(CH_2CH_2\overset{H}{N})_n(CH_2CH_2\overset{R}{N})_m CH_2CH_2NHR$$

where $R=-CH_2CH_2CH_2Si(OCH_3)_3$; $m=1$ to 5; and $n=5$ to 50. Also, peak pressure is reduced and pieziometric efficiency is improved by utilizing the coating of this invention.

DESCRIPTION OF THE PREFERRED EMBODIMENT

The prefered coatings for use in practicing this invention are these having the formula:

$$RNH(CH_2CH_2\overset{H}{N})_n(CH_2CH_2\overset{R}{N})_m CH_2CH_2NHR$$

wherein R is $-CH_2CH_2CH_2Si(OCH_3)_3$ wherein n is an integer having a value of from 5 to 50 and wherein m is an integer having a value of from 1 to 5.

The preferred material is an oligomer of 2000–3000 molecular weight. It can be prepared by reacting polyethyleneimine with 3-chloropropyltrimethoxysiline. The polyethyleneimine can be obtained in a wide variety of molecular weights. The number of silyl groups per molecule may be controlled by simply adjusting the amount of 3-chloropropyltrimethoxysilane used in the reaction.

To apply the coating, the oligomer may be dissolved in a solvent and the resulting solution brushed or sprayed on to the propellant or the oligomer itself may be applied as a neat liquid.

Upon application, it is believed that a siloxane polymer forms. It is theorized that the silane reacts with water in the nitrocellulose according to the equation:

$$-CH_2CH_2CH_2Si(OCH_3)_3 \xrightarrow{H_2O} -CH_2CH_2CH_2Si(OH)_3$$

and that the triol thus formed is unstable and quickly loses water to form a polysiloxane.

The gun propellants coated according to this invention may be either a single base propellant such as nitrocellulose or double base propellants made up of nitrocellulose and another ingredient such as nitroglycerine or trimethylol trinitrate.

As indicated above, the coating material may be applied either as a neat liquid as well as in the form of a solution. Neither of the two coating techniques is preferred over the other. Whether the material is applied as a neat liquid or from a solution, a tough durable coating quickly forms and the coating is strongly bonded to the propellant grain. Nor is one possible molecular weight of coating material preferred over another. All work equally well as long as the molecular weight is in the 2000 to 3000 range.

The coating tends to (1) lower peak pressure and (2) flatten out the pressure-time curve. That is, pressure in the chamber builds up to a lower peak but lasts longer than in the case when uncoated propellant is used. The lower peak pressure has the advantage of decreasing throat erosion which permits the use of thinner and thus lighter chambers. This also has the advantage of increasing the efficiency of the propellant.

When one coats the propellant with a polymer according to this invention, propellants are attained which permit the use of guns which are lighter. Another result is that the projectiles are fired with higher velocities.

If a solution is used to apply the coating, any solvent which will dissolve the oligomer, not react adversely with the propellant and which will evaporate fairly rapidly may be used. Examples of suitable solvents include methanol and ethanol.

What is claimed is:

1. A method for improving the efficiency of and lowering the peak pressure produced by a high force, high flame temperature gun propellant comprising the steps of:

A. coating the propellant with an oligomer having the formula:

$$RHN(CH_2CH_2\overset{H}{N})_n(CH_2CH_2\overset{R}{N})_m CH_2CH_2NHR$$

wherein R is $-CH_2CH_2CH_2Si(OCH_3)_3$, wherein n is an integer having a value of from 5 to 50 and wherein m is an integer having a value of from 1 to 5; and B. allowing the oligomer to form a polymer.

2. A method according to claim 1 wherein the coating of the oligomer is applied in the form of a neat liquid.

3. A method according to claim 1 wherein the coating of the oligomer is applied in the form of a solution.

4. A method according to claim 3 wherein said solution consists essentially of the oligomer dissolved in a solvent selected from the group consisting of methanol and ethanol.

* * * * *